US007037561B2

(12) United States Patent
Narita et al.

(10) Patent No.: US 7,037,561 B2
(45) Date of Patent: May 2, 2006

(54) SECURITY ELEMENT, THERMAL TRANSFER SHEET, INTERMEDIATE TRANSFER RECORDING MEDIUM, AND METHOD FOR FORMATION OF SECURITY ELEMENT

(75) Inventors: Satoshi Narita, Shinjuku-ku (JP); Koji Eto, Shinjuku-Ku (JP); Hideshi Hattori, Shinjuku-Ku (JP); Daisuke Matsuura, Shinjuku-Ku (JP); Kazutoshi Awano, Shinjuku-Ku (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 82 days.

(21) Appl. No.: 10/390,783

(22) Filed: Mar. 19, 2003

(65) Prior Publication Data

US 2003/0180482 A1 Sep. 25, 2003

(30) Foreign Application Priority Data

Mar. 19, 2002 (JP) ..... 2002-076003
Feb. 28, 2003 (JP) ..... 2002-053557

(51) Int. Cl.
*B41M 5/30* (2006.01)

(52) U.S. Cl. ..... 428/32.51; 156/235; 283/114; 428/32.6; 428/32.69; 428/32.74

(58) Field of Classification Search ..... 428/32.69, 428/32.74, 690, 32.51, 32.6; 156/235; 283/114
See application file for complete search history.

(56) References Cited

U.S. PATENT DOCUMENTS

| | | | | |
|---|---|---|---|---|
| 4,451,530 | A | 5/1984 | Kaule et al. | 428/323 |
| 5,516,590 | A | 5/1996 | Olmstead et al. | 428/484 |
| 6,308,630 | B1 * | 10/2001 | Kurokawa et al. | 101/492 |
| 6,368,684 | B1 * | 4/2002 | Onishi et al. | 428/32.6 |

FOREIGN PATENT DOCUMENTS

| | | |
|---|---|---|
| EP | 0 595 583 | 5/1994 |
| EP | 1 179 808 | 2/2002 |
| EP | 1 270 246 | 1/2003 |

* cited by examiner

*Primary Examiner*—B. Hamilton Hess
(74) *Attorney, Agent, or Firm*—Oliff & Berridge, PLC

(57) ABSTRACT

The present invention provides a security element which is low in cost, is difficult to forge or alter, and can be applied to objects where a high level of security is required. The security element comprises at least a substrate and a fluorescent colorant layer provided on the substrate, wherein the fluorescent colorant layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

17 Claims, 3 Drawing Sheets

SECURITY ELEMENT, THERMAL TRANSFER SHEET, INTERMEDIATE TRANSFER RECORDING MEDIUM, AND METHOD FOR FORMATION OF SECURITY ELEMENT

TECHNICAL FIELD

The present invention relates to a security element for use in distinguishment between a forgery and a genuine one by visual inspection, and also to a thermal transfer sheet and an intermediate transfer recording medium for the formation of a security element and a method for the formation of a security element.

BACKGROUND ART

At the present time, a wide variety of prints are prepared and used. The number of types of these prints tends to be increased. This is because the development and sophistication of society have led to a significantly broadened range of applications where prints are used, as well as to stricter demands to be satisfied by the prints. For example, the function of preventing duplication and the function of identifying the print as a genuine print are strictly required of prints, which should not be forged, such as ID cards or passports. Further, for commercial prints such as calendars and posters, in order to draw attention, a technique is sometimes used which enables an image to be formed only when the prints have been exposed to specific conditions.

To meet these demands, prints have been developed in which, upon exposure to specific light other than visible light, an image perceivable with the naked eye appears, although the image cannot be perceived with the naked eye under ordinary visible light. In these prints, a fluorescent ink, which emits visible light upon exposure to excitation light such as ultraviolet light, has been printed.

In recent years, however, the fluorescent ink and, in addition, black light as a portable ultraviolet light exposure system have become relatively easily available, and, consequently, prints utilizing the conventional fluorescent ink have become easy to forge or alter. This has disadvantageously made it difficult to guarantee a high level of security.

DISCLOSURE OF THE INVENTION

In view of the above problems of the prior art, the present invention has been made, and an object of the present invention is to provide a security element which is low in cost, is difficult to forge or alter, and can be applied to objects where a high level of security is required.

Another object of the present invention is to provide a thermal transfer sheet and an intermediate transfer recording medium which can realize the preparation of a security element, for use in the production of objects having a high level of security, in a simple manner without use of any large apparatus or a complicate machine.

The above object can be attained by a security element comprising at least a substrate and a fluorescent colorant layer provided on the substrate, wherein said fluorescent colorant layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

In a preferred embodiment of the security element according to the present invention, the fluorescent colorant $F_1$ is substantially white or colorless under visible light and, upon absorption of ultraviolet or infrared light, emits fluorescence.

In the security element according to the present invention, the fluorescent colorant $F_1$ may be excited by light with a wavelength in the range of 500 nm to 2,000 nm to cause upconversion emission.

Further, in the security element according to the present invention, the fluorescent colorant $F_1$, which causes the upconversion emission, may contain one or more rare earth elements selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) and mixtures thereof.

In the security element according to the present invention, fixed image information and/or variable image information may be provided by the fluorescent colorants. In this case, the fixed (image) information is fixed uniform information common to a plurality of members (a large number of members) belonging to, for example, a company, a school, or a party or group, provided in the issue of security elements such as ID cards or passports. On the other hand, the variable (image) information is information, which varies from member to member in a plurality of members belonging to, for example, a company, a school, or a party or group, and is variable individual information which is rewritten for each unit of the security element in the issue of security elements such as ID cards or passports.

According to another aspect of the present invention, there is provided a thermal transfer sheet comprising at least a substrate and a heat-fusion ink layer provided on the substrate, wherein said heat-fusion ink layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

In a preferred embodiment of the thermal transfer sheet according to the present invention, the fluorescent colorant $F_1$ is substantially white or colorless under visible light and, upon absorption of ultraviolet or infrared light, emits fluorescence.

Further, in the thermal transfer sheet according to the present invention, the fluorescent colorant $F_1$ may be excited by light with a wavelength in the range of 500 nm to 2,000 nm to cause upconversion emission.

Further, in the thermal transfer sheet according to the present invention, the fluorescent colorant $F_1$, which causes the upconversion emission, may contain one or more rare earth elements selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) and mixtures thereof.

The thermal transfer sheet according to the present invention may comprise fixed image information and/or variable image information provided by the fluorescent colorants.

According to still another aspect of the present invention, there is provided an intermediate transfer recording medium comprising at least a substrate and a transfer part including a receptive layer and provided separably on the substrate, wherein said receptive layer or said transfer part in its part other than the receptive layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

In a preferred embodiment of the intermediate transfer recording medium according to the present invention, the fluorescent colorant $F_1$ is substantially white or colorless under visible light and, upon absorption of ultraviolet or infrared light, emits fluorescence.

In the intermediate transfer recording medium according to the present invention, the fluorescent colorant $F_1$ may be excited by light with a wavelength in the range of 500 nm to 2,000 nm to cause upconversion emission.

Further, in the intermediate transfer recording medium according to the present invention, the fluorescent colorant $F_1$, which causes the upconversion emission, may contain one or more rare earth elements selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) and mixtures thereof.

The intermediate transfer recording medium according to the present invention may comprise fixed image information and/or variable image information provided by the fluorescent colorants.

According to a further aspect of the present invention, there is provided a method for forming a security element comprising at least a substrate and a fluorescent colorant-containing heat-fusion ink layer provided on the substrate, said method comprising the step of: transferring the heat-fusion ink layer in the above thermal transfer sheet onto the substrate.

According to another aspect of the present invention, there is provided a method for forming a security element comprising at least a substrate and a transfer part provided on the substrate, said method comprising the steps of: transferring a colorant onto the receptive layer in the above intermediate transfer recording medium; and transferring the transfer part including the receptive layer with the colorant transferred thereonto onto the substrate.

The security element according to the present invention comprises at least a substrate and a fluorescent colorant layer. The fluorescent colorant layer contains two or more fluorescent colorants ($F_1$, $F_2$ . . . , $F_n$ wherein n is an integer of two or more). The fluorescent colorant $F_1$ absorbs light with a wavelength of $\lambda_1$ and emits fluorescence with a wavelength of $\lambda_2$, and the fluorescent colorant $F_2$ absorbs light with a wavelength of $\lambda_2$ and emits fluorescence with a wavelength of $\lambda_3$. When these fluorescent colorants are used in the same fluorescent colorant layer, upon the application of a single light with a wavelength of $\lambda_1$ to the security element, two or more types of fluorescence different from each other or one another in color, for example, fluorescence with a wavelength of $\lambda_2$, fluorescence with a wavelength of $\lambda_3$, and fluorescence with a wavelength of $\lambda_4$, are simultaneously emitted. In this case, since these fluorescent colors are finely strewn and dispersed, the forgery and alteration of the security element are difficult. Thus, a security element having a high level of security can be provided. When rare earth element-containing fine particles, which are not easily available and absorb infrared light and cause upconversion emission, are used in the light emitting colorant $F_1$, a further improvement in security can be realized.

BEST MODE FOR CARRYING OUT THE INVENTION

The present invention will be described in more detail with reference to the following preferred embodiments.

Security Element

Figure 1:
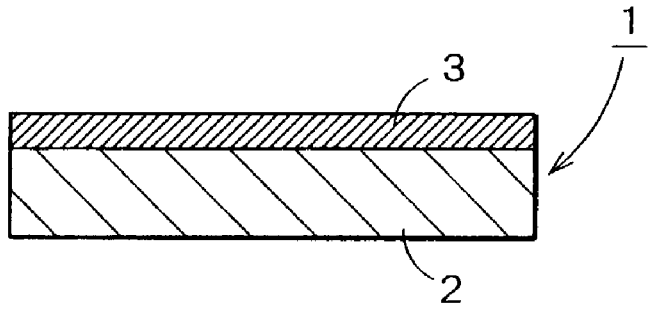
FIG. 1 is a schematic cross-sectional view showing one embodiment of the security element according to the present invention.

FIG. 1 is a schematic cross-sectional view showing one embodiment of the security element according to the present invention. In a security element 1 shown in FIG. 1, a fluorescent colorant layer 3 is provided on the whole area of one side of a substrate 2.

Figure 2:
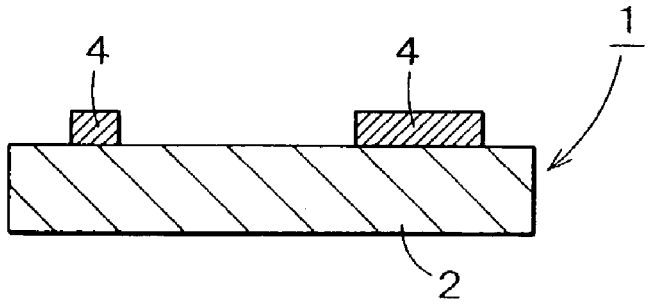
FIG. 2 is a schematic cross-sectional view showing another embodiment of the security element according to the present invention.

FIG. 2 is a schematic cross-sectional view showing another embodiment of the security element according to the present invention. In a security element 1 shown in FIG. 2, fixed information 4 as a fluorescent colorant layer is provided on a part of one side of a substrate 2.

Figure 3:
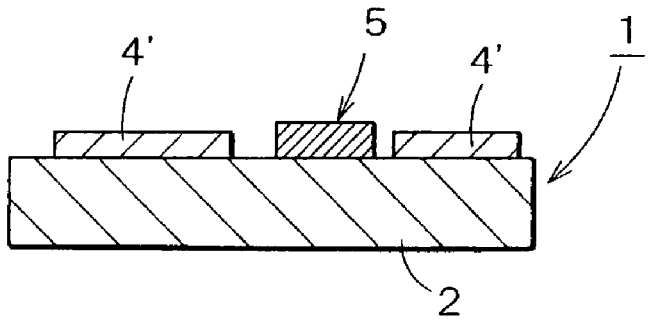
FIG. 3 is a schematic cross-sectional view showing a further embodiment of the security element according to the present invention.

FIG. 3 is a schematic cross-sectional view showing a further embodiment of the security element according to the present invention. In a security element 1 shown in FIG. 3, variable information 5 as a fluorescent colorant layer and fixed information 4' as a layer, which is not a fluorescent colorant layer and has been printed using an offset ink, are provided on a part of one side of a substrate 2.

Each layer constituting the security element according to the present invention will be described.

(Substrate)

The substrate 2 of the security element is not particularly limited, and examples of the substrate 2 usable herein include sheets or three-dimensional molded products of plain paper, wood free paper, tracing paper, and various plastics. The shape of the substrate 2 maybe any of cards, postal cards, passports, letter papers, report pads, notebooks, catalogs, cups, cases, building materials, panels, telephones, radios, televisions and other electronic components, rechargeable batteries and the like.

(Fluorescent Colorant Layer)

Examples of methods usable for the formation of the fluorescent colorant layer constituting the security element according to the present invention include: various conventional printing methods; a method wherein a fluorescent colorant layer is formed by providing a thermal transfer sheet comprising a substrate and a heat-fusion ink layer containing two or more fluorescent colorants, which will be described later, on the substrate and transferring the heat-fusion ink layer onto a substrate of a security element; and a method wherein a fluorescent colorant layer is formed by providing an intermediate transfer recording medium comprising a substrate, which will be described later, and a transfer part, containing two or more fluorescent colorants, including at least a receptive layer provided separably on the substrate, and transferring the transfer part onto a substrate of a security element.

When the fluorescent colorant layer is formed on a substrate of a security element by various printing methods, an ink, for the fluorescent colorant layer, comprising a vehicle and a plurality of fluorescent colorants known in the field of conventional printing inks as main components and optional additives is properly formulated to prepare an ink suitable for various printing methods, such as flexogravure printing, letterpress printing, offset printing, or silk screen printing, and the ink is printed on the substrate in its necessary site.

Two or more fluorescent colorants ($F_1, F_2, \ldots, F_n$ wherein n is an integer of two or more) are preferably contained in the ink for a fluorescent colorant layer. The fluorescent colorant $F_1$ absorbs light with a wavelength of $\lambda_1$ and emits fluorescence with a wavelength of $\lambda_2$, and the fluorescent colorant $F_2$ absorbs light with a wavelength of $\lambda_2$ and emits fluorescence with a wavelength of $\lambda_3$. If necessary, the ink for a fluorescent colorant layer further contains a fluorescent colorant $F_3$ which can absorb light with a wavelength of $\lambda_3$ and can emit fluorescence with a wavelength of $\lambda_4$.

Thus, in the present invention, the fluorescent colorant layer contains a fluorescent colorant ($F_1$), which, upon exposure to a light beam, preferably other than visible light, that is, ultraviolet light or infrared light (wavelength $\lambda_1$), absorbs the light and emits fluorescence with a wavelength other than the wavelength $\lambda_1$, and contains another fluorescent colorant ($F_2$), which absorbs fluorescence with the wavelength emitted from the fluorescent colorant ($F_1$) and emits fluorescence with a wavelength region different from the wavelength emitted from the fluorescent colorant ($F_1$). Preferably, the fluorescent colorant layer contains a further fluorescent colorant ($F_3$) which absorbs the fluorescence with the wavelength emitted from the fluorescent colorant ($F_2$) and emits fluorescence with a wavelength region different from the wavelength emitted from the fluorescent colorant ($F_2$).

Specifically, the fluorescent colorant layer contains N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$. Here N is 2 or more, preferably 2 or 3 from the practical point of view.

Not only organic fluorescent colorants but also inorganic fluorescent colorants may be used as the fluorescent colorants used in the present invention so far as the fluorescent colorant ($F_n$) emits fluorescence that is absorbed in another fluorescent colorant ($F_{n+1}$) which emits fluorescence with a wavelength different from the fluorescence emitted from the fluorescent colorant ($F_n$). A mixture of a plurality of organic fluorescent colorants may be used. An inorganic colorant may also be used as a mixture thereof with an organic fluorescent colorant(s) or with a different inorganic fluorescent colorant(s).

Fluorescent colorants may be dyes or fine particles which can give off fluorescence upon exposure to excitation light and may be color or colorless under visible light. The fluorescent colorants, however, are preferably substantially white or colorless under visible light and, upon exposure to ultraviolet or infrared light, absorb the ultraviolet or infrared light and emit fluorescence.

Fluorescent dyes, which are color under visible light, emit the same color as obtained by dyeing. Examples of fluorescent dyes include basic dyes such as Cation Brilliant Flavine (yellow), Cation Brilliant Red (red), Cation Brilliant Pink (pink), Spilon Yellow (yellow), Spilon Red (red), and SOT Pink (pink) manufactured by Hodogaya Chemical Co., Ltd., Basic Yellow, Rhodamine B and the like.

Organic fluorescent colorants include diaminostilbendisulfonic acid derivatives, imidazole derivatives, coumarin derivatives, derivatives of triazole, carbazole, pyridine, naphthalic acid, imidazolone and the like, colorants such as fluorescein and eosin, and benzene ring-containing compounds such as anthracene. Specific examples of fluorescent dyes, which are colorless under visible light, include EB-501 (emission color: blue, manufactured by Mitsui Chemicals Inc.), EG-302 (emission color: yellowish green, manufactured by Mitsui Chemicals Inc.), EG-307 (emission color: green, manufactured by Mitsui Chemicals Inc.), ER-120 (emission color: red, manufactured by Mitsui Chemicals Inc.), ER-122 (emission color: red, manufactured by Mitsui Chemicals Inc.), Uvitex OB (emission color: blue, manufactured by Ciba-Geigy) called a fluorescent brightener, and europium-thenoyltrifluoroacetone chelate (emission color: reddish orange, manufactured by Sinloihi Co., Ltd.).

Inorganic fluorescent colorants include pigments produced by providing crystals of oxides, sulfides, silicates, phosphates, tungstates or the like of calcium (Ca), barium (Ba), magnesium (Mg), zinc (Zn), cadmium (Cd) or the like as a main component and adding a metallic element, such as manganese (Mn), zinc, silver (Ag), copper (Cu), antimony (Sb), or lead (Pb), or a rare earth element, such as elements belonging to lanthanoids, as an activator to the main component, and firing the mixture. Specific examples of such pigments include ZnO:Zn, Br(PO)Cl:Eu, ZnGeO:Mn, YO:Eu, Y(P,V)O:Bu, YOSi:Eu and the like, and rare earth element-containing fine particles which mainly absorb infrared light and cause upconversion emission.

Figure 4A:
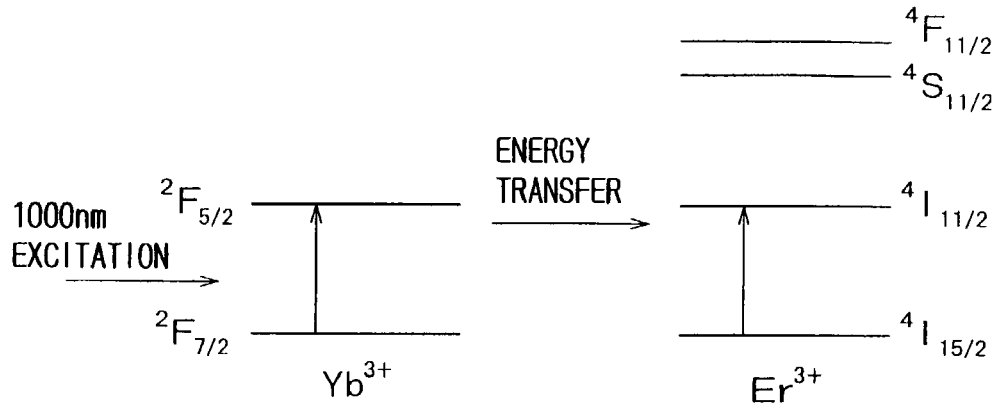
FIG. 4A is an explanatory view of upconversion emission.
Figure 4B:
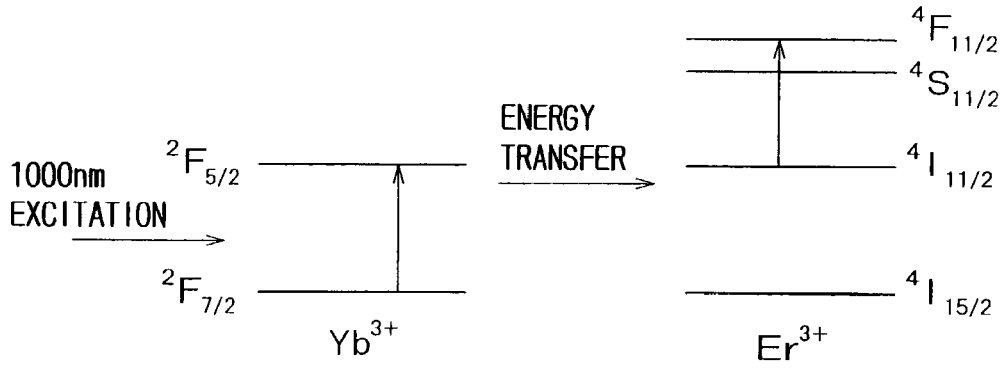
FIG. 4B is an explanatory view of upconversion emission.
Figure 4C:
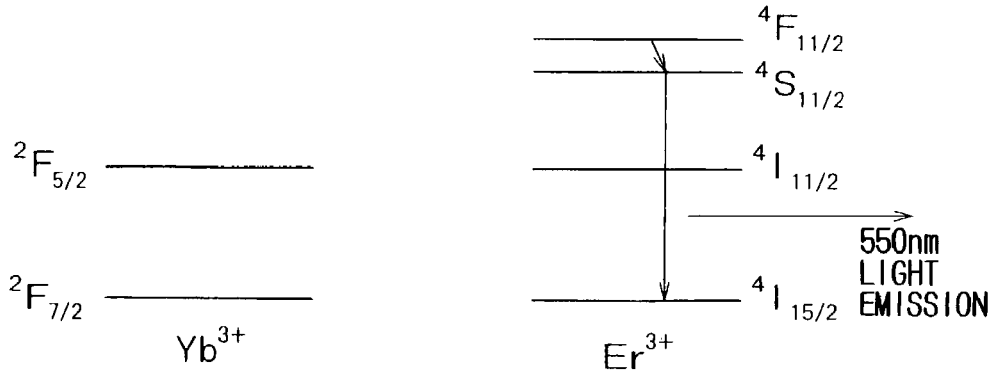
FIG. 4C is an explanatory view of upconversion emission.

The upconversion emission will be described with reference to FIGS. 4A to 4C. FIGS. 4A to 4C show the results of an experiment on a system wherein ytterbium (Yb) and erbium (Er) are used as rare earth elements and infrared light with a wavelength of 1,000 nm has been applied as excitation light. At the outset, as shown in FIG. 4A, ytterbium is excited by the 1,000 nm excitation light, and the energy level of ytterbium is transferred from $^2F_{7/2}$ to a higher energy level $^2F_{5/2}$. Due to the energy transfer, this energy pushes up the energy level of erbium from $^4I_{15/2}$ to $^4I_{11/2}$. Likewise, as shown in FIG. 4B, ytterbium is excited by excitation light with a wavelength of 1,000 nm, and, due to the energy transfer, this energy further pushes up the energy level of erbium from $^4I_{11/2}$ to $^4F_{11/2}$. As shown in FIG. 4C, in returning the excited erbium to the ground state, erbium emits light with a wavelength of 550 nm. Thus, when a material excited by 1,000 nm-wavelength light emits higher-energy light, i.e., 550 nm-wavelength light, that is, emits light with a higher energy than the excitation light, this phenomenon is called upconversion emission.

Silicon (Si) nanoparticles, which cause two-photon excitation, may be mentioned as a material which has similar effect. However, it should be noted that silicon nanoparticles are excited only when two photons have been simultaneously absorbed, and, thus, the principle of the two-photon excitation is different from that of the upconversion emission. Further, in the two-photon excitation, since two photons should be simultaneously present, the emission efficiency is poor. On the other hand, in the upconversion emission, there is no such need, and the emission efficiency is much higher than that in the two-photon excitation caused by the silicon nanoparticles.

Rare earth elements, which can be brought to trivalent ions, may be generally mentioned as rare earth elements which can cause the upconversion emission. Among others, at least one rare earth element selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) is preferred.

The excitation wavelength for the rare earth element, which causes the upconversion emission, is a wavelength, for example, falling within the range of 500 nm to 2,000 nm, preferably within the range of 700 nm to 2,000 nm, particularly preferably within the range of 800 nm to 1,600 nm.

The rare earth element used in the preferred embodiment of the present invention is not particularly limited so far as, as described above, the rare earth element is excited by light with a wavelength falling within the above-defined wavelength range and can cause upconversion emission. Only one rare earth element may be used, or alternatively two or more rare earth elements may be simultaneously used. The upconversion emission mechanism in the case of the use of only one rare earth element will be described by taking an $Er^{3+}$-doped material as an example. For example, upon the application of light with a wavelength of 970 nm or 1,500 nm as excitation light, at the energy level of $Er^{3+}$ ion after an upconversion process, visible light is emitted, for example, with wavelengths of 410 nm ($^2H_{9/2}$—$^4I_{15/2}$), 550 nm ($^4S_{3/2}$—$^4I_{15/2}$), and 660 nm ($^4F_{9/2}$—$^4I_{15/2}$).

In the preferred embodiment of the present invention, since the rare earth element, which causes the upconversion emission, can be used, excitation by high-energy light, for example, by ultraviolet light, is not necessary. In general, the wavelength of light for light emission is preferably that of visible light from the viewpoint of ease of analysis or detection. Therefore, in the upconversion emission, light with longer wavelength, such as infrared light, is used as the excitation light.

Thus, the rare earth element-containing fine particles according to the present invention use rare earth element which can cause upconversion emission. Therefore, the emission efficiency is much higher than that provided by the two-photon excitation. Further, the storage stability and the like are better than those in the case where an organic phosphor is used. In the security element using the rare earth element which can cause upconversion emission, the forgery is difficult because the rare earth element is not easily available. Further, since the emission color varies depending upon the composition of the rare earth element, any desired $\lambda_2$ can be selected. Therefore, a high level of customizability of a combination of fluorescent colorants $F_1$, $F_2$, . . . can be realized.

The rare earth element-containing fine particles are not particularly limited so far as the rare earth element is contained in such a state that can cause upconversion emission. For example, the rare earth element-containing fine particles may be in such a form that the rare earth element has been incorporated in an organic material, for example, a complex or a dendrimer. In general, however, the rare earth element-containing fine particles are preferably in such a form that the above rare earth element has been incorporated in an inorganic base material. This is because the rare earth element can be easily incorporated in such a state that can emit light.

The inorganic base material is preferably a material which is transparent to excitation light from the viewpoint of emission efficiency. Specific examples of suitable base materials include halides, such as fluorides and chlorides, oxides, and sulfides. Halides are preferred from the viewpoint of emission efficiency. Specific examples of preferred halides include barium chloride ($BaCl_2$), lead chloride ($PbCl_2$), lead fluoride ($PbF_2$), cadmium fluoride ($CdF_2$), lanthanum fluoride ($LaF_3$), and yttrium fluoride ($YF_3$). Among others, barium chloride ($BaCl_2$), lead chloride ($PbCl_2$), and yttrium fluoride ($YF_3$) are preferred.

On the other hand, oxides may be mentioned as base materials which are stable against water and the like and thus have high environmental resistance. Specific examples of such oxides include yttrium oxide ($Y_2O_3$), aluminum oxide ($Al_2O_3$), silicon oxide ($SiO_2$), and tantalum oxide ($Ta_2O_5$). Among others, yttrium oxide ($Y_2O_3$) is preferred.

When a halide is used as the base material for the fine particles, the circumference of the fine particles is preferably covered with a protective layer. Specifically, since the halide is generally unstable against water or the like, a covering material having waterproof and other properties is preferably formed on the circumference of the fine particles using the halide as the base material. In this case, the above-described oxides may be suitably used as the covering material.

Regarding methods for doping the rare earth element into the base material, when the base material is a halide, for example, barium chloride ($BaCl_2$), a method as described in Japanese Patent Laid-Open No. 208947/1997 or technical literature ("Efficient 1.5 mm to Visible Upconversion in $Er^{3+}$ Doped Halide Phosphors" Junichi Ohwaki, et al, P. 1334–1337, JAPANESE JOURNAL OF APPLIED PHYSICS, Vol. 31 part 2 No. 3A, Mar. 1, 1994) may be used. When the base material is an oxide, a method as described in Japanese Patent Laid-Open No. 3261/1995 or technical literature ("Green Upconversion Fluorescence in $Er^{3+}$ Doped $Ta_2O_5$ Heated Gel" Kazuo Kojima et al, Vol. 67(23), 4 Dec. 1995; "Relationship Between Optical Properties and Crystallinity of Nanometer $Y_2O_3$: Eu Phosphor" APPLIED PHYSICS LETTERS, Vol. 76, No. 12, p. 1549–1551 , 20 Mar. 2000) may be used.

In the present invention, the amount of the rare earth element doped into the base material significantly varies depending upon the type of the rare earth element, the type of the base material, and the necessary level of light emission and may be properly determined according to various conditions.

The average particle diameter of the rare earth element-containing fine particles is preferably 1 nm to 500 nm, more preferably 1 nm to 100 nm, still more preferably 1 nm to 50 nm. Fine particles having an average particle diameter of less than 1 nm are unfavorable because the synthesis of such fine particles is very difficult.

Methods usable for preparing the rare earth element-containing fine particles include: vaporization-in-gas methods including radio-frequency plasma methods; sputtering methods; glass crystallization methods; chemical precipitation methods; reversed micelle methods; sol-gel methods and methods similar thereto; hydrothermal synthesis methods; sedimentation methods including coprecipitation methods; and spray methods.

(Preferred Embodiments of Security Element)

The security element according to the present invention comprises at least a substrate and a fluorescent colorant layer. One or more intermediate layers may be provided between the substrate and the fluorescent colorant layer. The intermediate layer refers to all layers provided between the fluorescent colorant layer and the substrate, such as an adhesive layer, a barrier layer, a foamed layer, and an antistatic layer, and any of conventional layers commonly used as the intermediate layer may be used according to need. The addition of a white pigment to the intermediate layer for improving the whiteness for concealing the texture of the surface of the substrate can further broaden the freedom in the selection of the security element. Suitable white pigments include titanium oxide, zinc oxide, barium sulfate, calcium carbonate, and talc. Further, the addition of a fluorescent brightener or the like can also improve visual texture.

The adhesive layer constituting the intermediate layer has the effect of increasing the adhesion of the fluorescent colorant layer to the substrate. In particular, when the fluorescent colorant layer is provided by thermal transfer, the adhesive layer can facilitate the adhesion of the fluorescent colorant layer to the substrate of the security element. Adhesives usable for the formation of the adhesive layer include heat-fusion adhesives such as acrylic resins, styrene-acryl copolymers, vinyl chloride resins, vinyl chloride-vinyl acetate copolymers, polyester resins, and polyamide resins. The thickness of the adhesive layer is determined so that the adhesion between the substrate and the adhesive layer is good. In general, however, the thickness of the adhesive layer is preferably 0.1 to 20 $g/m^2$, more preferably 0.5 to 2.5 $g/m^2$, on a dry basis.

In the security element according to the present invention, image information, such as marks, logotypes, and trademarks of companies, schools, parties or groups and the like, or character information, such as names of companies, schools, parties or groups and the like, may be provided as fixed (image) information by the fluorescent colorant layer on the substrate.

Further, in the security element, character information, for example, characters representing an ID (identification) number, a personal name, date of birth, age and the like, or a bar code, or image information, such as a photograph-like image of face, may be provided as variable (image) information by the fluorescent colorant layer on the substrate.

Thermal Transfer Sheet

Next, the present invention will be described in more detail with reference to the following preferred embodiments of the thermal transfer sheet.

Figure 5:
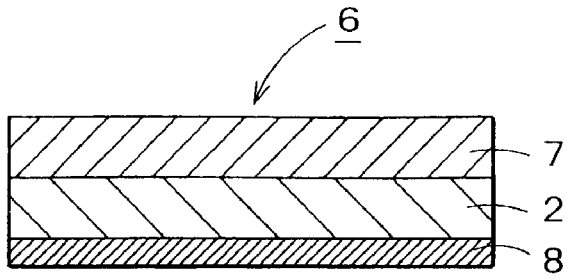
FIG. 5 is a schematic cross-sectional view showing one embodiment of the thermal transfer sheet according to the present invention.

FIG. 5 is a schematic cross-sectional view showing one embodiment of the thermal transfer sheet according to the present invention. A thermal transfer sheet 6 shown in FIG. 5 includes a substrate 2 and a heat-fusion ink layer 7 containing a plurality of fluorescent colorants provided on one side of the substrate 2. A backside layer 8 is provided on the other side of the substrate 2.

Figure 6:
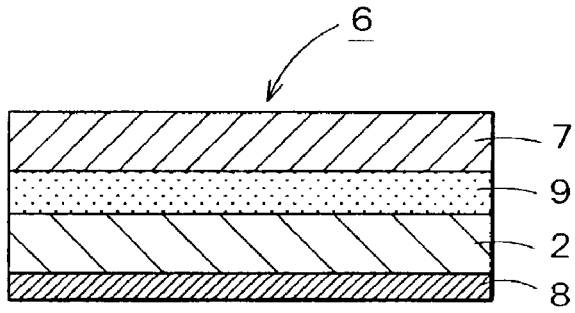
FIG. 6 is a schematic cross-sectional view showing another embodiment of the thermal transfer sheet according to the present invention.

FIG. 6 is a schematic cross-sectional view showing another embodiment of the thermal transfer sheet according to the present invention. A thermal transfer sheet 6 shown in FIG. 6 includes a substrate 2, a release layer 9 provided on one side of the substrate 2, and a heat-fusion ink layer 7 containing a plurality of fluorescent colorants provided on the release layer 9. That is, the heat-fusion ink layer 7 is provided on one side of the substrate 2 through the release layer 9. A backside layer 8 is provided on the other side of the substrate 2.

Each layer constituting the thermal transfer sheet according to the present invention will be described.

(Substrate)

The substrate of the thermal transfer sheet according to the present invention is not particularly limited. Specifically, substrates used in the conventional thermal transfer sheet as such may be used. Further, substrates having a surface subjected to easy-adhesion treatment or other treatment may also be used. Specific examples of preferred substrates include: plastic films, for example, films of polyesters including polyethylene terephthalate, polycarbonates, polyamides, polyimides, cellulose acetates, polyvinylidene chlorides, polyvinyl chlorides, polystyrenes, fluororesins, polypropylenes, polyethylenes, and ionomers; papers such as glassine paper, capacitor paper, and paraffin paper; cellophanes; and composite films of a laminate of two or more of the above materials. The thickness of the substrate may be properly varied depending upon the material of the substrate so that the strength and the heat resistance of the substrate are proper. In general, however, the thickness of the substrate is preferably about 2 to 100 μm.

(Heat-Fusion Ink Layer)

The heat-fusion ink layer 7 of the thermal transfer sheet in the present invention contains two or more fluorescent colorants ($F_1$, $F_2$, . . . , $F_n$ wherein n is an integer of 2 or more) in a single heat-fusion ink layer. In this case, the fluorescent colorant $F_1$ absorbs light with a wavelength of $\lambda_1$ and emits fluorescence with a wavelength of $\lambda_2$, and the fluorescent colorant $F_2$ absorbs light with a wavelength of $\lambda_2$ and emits fluorescence with a wavelength of $\lambda_3$. Therefore, for example, when the heat-fusion ink layer has a two-layer structure, a heat-fusion ink layer as the uppermost layer after transfer onto the object, that is, a heat-fusion ink layer on the substrate side in the state of the thermal transfer sheet, contains two or more fluorescent colorants. The fluorescent colorants per se may be the same as those contained in the fluorescent layer in the security element described above.

In this connection, a prior art technique is disclosed in Japanese Patent Laid-Open No. 232955/2001. Specifically, Japanese Patent Laid-Open No. 232955/2001 discloses a thermal ink transfer ink ribbon comprising a substrate sheet and, provided on the substrate sheet, a laminate of a first heat-fusion ink layer and a second heat-fusion ink layer. The first heat-fusion ink layer comprises a first fluorescent pigment, which emits light with a visible light wavelength region upon exposure to ultraviolet light and is colorless under visible light, and a colorant material. The second heat-fusion ink layer comprises a second fluorescent pigment, different from the first fluorescent pigment, which emits light with a visible light wavelength region upon exposure to ultraviolet light and is colorless under visible light, and a colorant material. In this prior art technique, only one fluorescent pigment is contained in one ink layer. According to the prior art technique, when only one ink layer is transferred onto an object using a thermal transfer ink ribbon formed of a laminate of a first heat-fusion ink layer containing a fluorescent colorant $F_1$ and a second heat-fusion ink layer containing a fluorescent colorant $F_2$, an object with the first heat-fusion ink layer transferred thereonto is provided. When single light with a wavelength of $\lambda_1$ is applied to this object with the first heat-fusion ink layer transferred thereonto, fluorescence of only one color is perceived. When the two ink layers are transferred onto an object using this thermal transfer ink ribbon, an object with the two ink layers transferred thereonto is provided. In this object with the first and second heat-fusion ink layers transferred thereonto, the fluorescent colorant $F_1$ absorbs light with a wavelength of $\lambda_1$ and emits fluorescence with a wavelength of $\lambda_2$, and the fluorescent colorant $F_2$ absorbs light with a wavelength of $\lambda_2$ and emits fluorescence with a wavelength of $\lambda_3$. However, upon the application of single light with a wavelength of $\lambda_1$ to this object, it is difficult to simultaneously detect both fluorescence with a wavelength of $\lambda_2$ and fluorescence with a wavelength of $\lambda_3$.

In the present invention, two or more fluorescent colorants are contained in a single fluorescent colorant layer (a single heat-fusion ink layer). Upon the application of single light with a wavelength of $\lambda_1$ to the object with the fluorescent colorant layer, two or more types of fluorescence such as fluorescence with a wavelength of $\lambda_2$, fluorescence with a wavelength of $\lambda_3$, and fluorescence with a wavelength of $\lambda_4$, are emitted and can be simultaneously and satisfactorily distinguished. This distinguishment can be made by visual inspection. Further, a high level of security function can be imparted by utilizing a security device provided with a genuineness determination mechanism comprising, for example, a combination of a light source of $\lambda_1$ with a sensor of $\lambda_2$, $\lambda_3$.

Further, in the present invention, two or more fluorescent colorants can be contained in a dispersed state in a single fluorescent colorant layer (a single heat-fusion ink layer). Therefore, the two or more fluorescent colors, for example, with a wavelength of $\lambda_2$, a wavelength of $\lambda_3$, and a wavelength of $\lambda_4$, are not emitted in respectively partitioned regions, but are emitted in a finely strewn state. Therefore, the forgery and alternation are difficult, and a high level of security can be realized.

In the heat-fusion ink layer, a binder resin possessing excellent abrasion resistance, transparency, hardness and other properties may be properly used. Specific examples of binder resins usable herein include polyester resins, vinyl chloride-vinyl acetate copolymers, polystyrene resins, acrylic resins, polyurethane resins, acrylated urethane resins, silicone-modified products of the above resins, polycarbonate resins, and mixtures of the above resins. Further, for example, a crosslinked and cured resin prepared by applying an ionizing radiation to an acrylic monomer or the like may also be used.

From the viewpoint of the transferability of the resin, highly transparent fine particles of silica, alumina, calcium carbonate, plastic pigments or the like, waxes, or the like may be incorporated in such an amount that does not sacrifice the transparency. For example, lubricants may be incorporated from the viewpoint of improving the abrasion resistance and glossiness and the like of an image.

In the heat-fusion ink layer, in addition to the binder resin and the fluorescent colorant, waxes as a binder may be used. Representative examples of waxes usable herein include microcrystalline wax, carnauba wax, and paraffin wax. Further, various other waxes, such as Fischer-Tropsh wax, various low-molecular weight polyethylenes, Japan wax, beeswax, spermaceti, insect wax, wool wax, shellac wax, candeliila wax, petrolactum, polyester wax, partially modified wax, fatty esters, and fatty amides, may also be used.

In the heat-fusion ink layer, the content of the fluorescent colorants is about 0.5 to 20% by weight based on the heat-fusion ink layer.

The heat-fusion ink layer may be formed by coating a coating liquid for a heat-fusion ink layer by conventional forming means, such as gravure printing, screen printing, or reverse roll coating using a gravure plate, and drying the coating. The thickness of the heat-fusion ink layer is about 0.5 to 10 g/m$^2$ on a dry basis.

In the thermal transfer sheet according to the present invention, a heat-fusion ink layer is provided separably on a substrate. In this case, the heat-fusion ink layer may be provided on the substrate through a release layer 9. The provision of the release layer 9 enables the heat-fusion ink layer to be more easily separated from the substrate upon heating. At the time of the thermal transfer, the release layer is not separated from the substrate and stays on the substrate side.

(Release Layer)

In the thermal transfer sheet, for some material combinations for the substrate and the heat-fusion ink layer, the separability of the heat-fusion ink layer from the substrate at the time of thermal transfer is sometimes unsatisfactory. In this case, a release layer may be previously provided on the substrate. The release layer may be formed of one or at least two materials selected from waxes, silicone waxes, and resins, for example, silicone resins, fluororesins, acrylic resins, polyvinyl alcohols, urethane resins, cellulosic resins, such as cellulose acetate, polyvinyl acetal resins, and polyvinyl butyral resins. When two or more materials are mixed together, suitable water-soluble resins may be used. The release layer may be formed by coating a coating liquid composed mainly of the above material by a conventional method, such as gravure coating or gravure reverse coating, and drying the coating. A coating thickness of about 0.01 to 2 g/m$^2$ suffices for satisfactory results. A material to be selected for use in the release layer should of course have proper separability from the heat-fusion ink layer. Further, what is important is that the adhesion of the release layer to the substrate is higher than the adhesion of the release layer to the heat-fusion ink layer. Unsatisfactory adhesion of the release layer to the substrate is causative of abnormal transfer such as transfer of the heat-fusion ink layer together with the release layer. When matte surface appearance is desired in a print after the transfer of the heat-fusion ink layer, a method may be adopted wherein various particles are incorporated in the release layer. Alternatively, a substrate having a surface, on the release layer side, subjected to matte treatment may be used.

In the thermal transfer sheet according to the present invention, a heat-fusion ink layer is provided separably on a substrate. In this case, the heat-fusion ink layer may be provided on the substrate through a peel layer from the viewpoint of improving the separability of the heat-fusion ink layer from the substrate upon heating. At the time of thermal transfer, this peel layer can be separated from the substrate.

(Peel Layer)

The peel layer may be formed by coating a coating liquid containing, for example, a material selected from waxes, silicone wax, silicone resin, fluororesin, acrylic resin, polyvinyl alcohol resin, cellulose derivative resin, polyvinyl acetal resin, polyvinyl butyral resin, vinyl chloride-vinyl acetate copolymer, chlorinated polyolefin or the like, and copolymers of a group of these resins by conventional forming means, such as gravure printing, screen printing, or reverse roll coating using a gravure plate, and drying the coating. The peel layer may contain fluorescent colorants described above in connection with the heat-fusion ink layer. When two or more fluorescent colorants are contained in the peel layer, there is no need to incorporate two or more fluorescent colorants in the heat-fusion ink layer. The thickness of the peel layer is about 0.01 to 5 g/m$^2$ on a dry basis.

Further, in the thermal transfer sheet, an adhesive layer may be provided on the heat-fusion ink layer provided on the substrate to improve the fixation of the heat-fusion ink layer onto an object at the time of thermal transfer. The adhesive layer is preferably formed of a material which develops an adhesive property upon heating. The adhesive layer may be formed using, for example, thermoplastic synthetic resin, naturally occurring resin, rubber, or wax by the same forming means as used in the formation of the peel layer. The thickness of the adhesive layer is about 0.01 to 5 g/m$^2$.

(Backside Layer)

In the thermal transfer sheet, a backside layer may be provided on the surface of the substrate remote from the heat-fusion ink layer from the viewpoint of preventing sticking of the thermal transfer sheet to a thermal head or the like and improving slipperiness.

The backside layer may be formed of a resin. Examples of resins usable for the formation of the backside layer include naturally occurring or synthetic resins, for example, cellulosic resins, such as ethylcellulose, hydroxycellulose, hydroxypropylcellulose, methylcellulose, cellulose acetate, cellulose acetate butyrate, or nitrocellulose, vinyl resins, such as polyvinyl alcohol, polyvinyl acetate, polyvinyl butyral, polyvinyl acetal, or polyvinyl pyrrolidone, acrylic resins, such as polymethyl methacrylate, polyethyl acrylate, polyacrylamide, or acrylonitrile-styrene copolymer, polyamide resins, polyvinyltoluene resins, coumarone-indene resins, polyester resins, polyurethane resins, and silicone-modified or fluorine-modified urethane. These resins may be used either solely or as a mixture of two or more. In order to further enhance the heat resistance of the backside layer, preferably, among the above resins, a resin containing a reactive group based on a hydroxyl group is used in combination with polyisocyanate or the like as a crosslinking agent to form a crosslinked resin layer.

In order to impart sidability against the thermal head, a solid or liquid release agent or lubricant may be added to the backside layer to impart heat-resistant slipperiness to the backside layer. Release agents or lubricants usable herein include, for example, various waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resins, and fine particles of inorganic compounds such as talc and silica. The content of the lubricant in the backside layer is about 5 to 50% by weight, preferably about 10 to 30% by weight.

The backside layer may be formed by dissolving or dispersing the above resin, optionally together with a release agent, a lubricant and the like, in a suitable solvent to prepare a coating liquid, coating the coating liquid by a conventional coating method, such as gravure coating, roll coating, or wire bar coating, and drying the coating. The coverage of the backside layer is about 0.1 to 10 g/m$^2$ on a dry basis.

Intermediate Transfer Recording Medium

Next, the present invention will be described in more detail with reference to the following preferred embodiments of the intermediate transfer recording medium.

Figure 7:
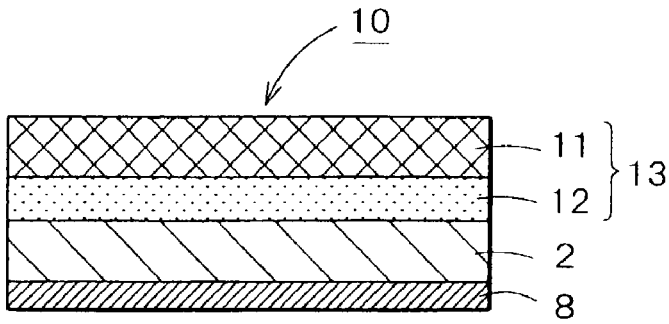
FIG. 7 is a schematic cross-sectional view showing one embodiment of the intermediate transfer recording medium according to the present invention.

FIG. 7 is a schematic cross-sectional view showing one embodiment of the intermediate transfer recording medium according to the present invention. An intermediate transfer recording medium 10 shown in FIG. 7 includes a substrate 2 and a transfer part 13 provided separably on one side of the substrate 2. The transfer part 13 comprises a peel layer 12 and a receptive layer 11 provided in that order on the substrate 2. A backside layer 8 is provided on the other side of the substrate 2.

Each layer constituting the intermediate transfer recording medium according to the present invention will be described.

(Substrate)

The substrate used in the intermediate transfer recording medium may be any substrate commonly used in conventional intermediate transfer recording media so far as the substrate can support the transfer part including at least a receptive layer and has strength and heat resistance. Specific examples of materials for the substrate include those described above in connection with the thermal transfer sheet.

The thickness of the substrate may be properly selected depending upon the material so that the strength, the heat resistance and the like are proper. In general, however, the thickness of the substrate is preferably about 1 to 50 μm.

(Receptive Layer)

The receptive layer is provided as a part of the transfer part constituting the intermediate transfer recording medium so as to locate on the surface of the intermediate transfer recording medium. An image is formed on the receptive layer by thermal transfer from the thermal transfer sheet having a colorant layer. The transfer part in the intermediate transfer recording medium with the image formed thereon is transferred onto an object to form a print.

To this end, a conventional resin material, which is receptive to a thermally transferable colorant, such as a sublimable dye or a heat-fusion ink, may be used as the material for the formation of the receptive layer. Examples of resin materials usable herein include: polyolefin resins such as polypropylene; halogenated resins such as polyvinyl chloride or polyvinylidene chloride; vinyl resins such as polyvinyl acetate, vinyl chloride-vinyl acetate copolymer, ethylene-vinyl acetate copolymer, or polyacrylic ester; polyester resins such as polyethylene terephthalate or polybutylene terephthalate; polystyrene resins; polyamide resins; resins of copolymers of olefins, such as ethylene or propylene, with other vinyl polymers; ionomers; cellulosic resins such as cellulose diastase; and polycarbonates. Vinyl chloride resins, acryl-styrene resins, or polyester resins are particularly preferred.

When the receptive layer is transferred onto an object through an adhesive layer, the receptive layer per se is not always required to have an adhesive property. When the receptive layer is transferred onto an object without through the adhesive layer, however, the receptive layer is preferably formed of a resin material having an adhesive property, such as a vinyl chloride-vinyl acetate copolymer.

The receptive layer constituting the transfer part in the intermediate transfer recording medium according to the present invention may contain fluorescent colorants as described above in connection with the fluorescent colorant layer in the security element.

The receptive layer may be formed by dissolving or dispersing one or at least two materials selected from the above materials, together with optional various additives or the like, in a suitable solvent, such as water or an organic solvent, to prepare a coating liquid for a receptive layer, coating the coating liquid by a method, such as gravure printing, screen printing, or reverse coating using a gravure plate, and drying the coating. The thickness of the receptive layer is about 1 to 10 g/m$^2$ on a dry basis.

In the intermediate transfer recording medium according to the present invention, the receptive layer may be provided on the substrate through a peel layer. Further, an adhesive layer may be provided on the receptive layer. The same material and formation method as used in the formation of the peel layer and the adhesive layer in the thermal transfer sheet may be applied to the formation of the peel layer and the adhesive layer in the intermediate transfer recording medium.

When the intermediate transfer recording medium comprises a substrate and, separably provided on the substrate, a transfer part, for example, comprising a peel layer and a receptive layer or comprising a receptive layer and an adhesive layer, that is, when the transfer part comprises a receptive layer and other layer(s), two or more fluorescent colorants ($F_1$, $F_2$, . . . , $F_n$ wherein n is an integer of two or more) may be previously contained in a single layer except for the receptive layer so that a coating pattern of the single layer represents fixed information. In this case, the fluorescent colorant $F_1$ absorbs light with a wavelength of $\lambda_1$ and emits fluorescence with a wavelength of $\lambda_2$, and the fluorescent colorant $F_2$ absorbs light with a wavelength of $\lambda_2$ and emits fluorescence with a wavelength of $\lambda_3$. The fluorescent colorants contained in the single layer may be the same as those described above in connection with the fluorescent colorant layer in the security element.

Method for Formation of Security Element

The method for the formation of a security element according to the present invention may comprise the steps of: providing the above thermal transfer sheet; and transferring the heat-fusion ink layer containing different fluorescent colorants onto a substrate to form a security element comprising at least a substrate and a fluorescent colorant layer of the heat-fusion ink layer.

In the preparation of a security element, a fluorescent colorant layer may be provided on a substrate by various conventional printing methods such as flexogravure printing, letterpress printing, offset printing, or silk screen printing. In this case, however, a commonly adopted method is that one printing plate is prepared and an identical design is printed in a plurality of units. Therefore, in practice, the fluorescent colorant layer is likely to be limited to fixed information.

By contrast, when a fluorescent colorant layer is formed by transferring the above heat-fusion ink layer containing different fluorescent colorants onto a substrate, regarding energy applied to heating means, such as a thermal head, suitable energy applied for fixed information and suitable energy applied for variable information can be simply used separately from each other.

Further, the method for the formation of a security element according to the present invention may also be carried out by providing the above-described intermediate transfer recording medium and a thermal transfer sheet comprising a substrate and a thermally transferable colorant layer, which may be a sublimable dye-containing dye layer or a heat-fusion ink layer, provided on the substrate, transferring the colorant from the thermal transfer sheet onto the receptive layer in the intermediate transfer recording medium to form an image, and then transferring the transfer part containing different fluorescent colorants from the intermediate transfer recording medium onto a substrate. The security element formed by this method comprises at least a substrate and a transfer part transferred from the intermediate transfer recording medium.

In this case, different fluorescent colorants are contained in a single receptive layer in the transfer part or a single layer except for the receptive layer in the transfer part of the intermediate transfer recording medium. Therefore, a combination of information part (fixed information), which emits fluorescence of two or more colors, with images or character information formed by thermal transfer can be realized.

In the method for the formation of a security element according to the present invention, in thermally transferring the heat-fusion ink layer containing different fluorescent colorants in the thermal transfer sheet onto a substrate as an object to form an image, means for pattern heating may be thermal energy application means commonly used in conventional thermal transfer, such as heating by a thermal head or laser beam irradiation.

Heating means used for the formation of a thermal transfer image in the receptive layer of the intermediate transfer recording medium may also be thermal energy application means commonly used in conventional thermal transfer.

Examples of means usable for transferring the transfer part including a receptive layer with an image formed thereon onto an object include a thermal head used in the formation of the transfer image, a line heater, a heat roll, and a hot stamp.

EXAMPLES

The following examples and comparative examples further illustrate the present invention. In the following description, "parts" or "%" is by weight unless otherwise specified.

Example 1-1

A 50 μm-thick polyethylene terephthalate film manufactured by Toray Industries, Inc. was provided as a substrate. A coating liquid 1 having the following composition for a fluorescent colorant layer was thoroughly stirred to prepare a dispersion. The dispersion was coated onto one side of the substrate by means of a wire bar at a coverage of 5 g/m$^2$ on a dry basis. The coating was fully dried in a hot air oven to prepare a security element of Example 1-1.

| <Coating liquid 1 for fluorescent colorant layer> | |
|---|---|
| Polyester resin (Vylon RV 200, manufactured by Toyobo Co., Ltd.) | 30 parts |
| Fluorescent colorant 1 (C.I. Fluorescent 90) | 0.5 part |
| Fluorescent colorant 2 (Sinloihi Color 305, manufactured by Sinloihi Co., Ltd.) | 0.5 part |
| Toluene | 35 parts |
| Methyl ethyl ketone | 35 parts |

Example 1-2

A security element of Example 1-2 was prepared in the same manner as in Example 1-1, except that the coating liquid for a fluorescent colorant layer used in the preparation of the security element of Example 1-1 was changed to a coating liquid 2 having the following composition for a fluorescent colorant layer.

| <Coating liquid 2 for fluorescent colorant layer> | |
|---|---|
| Polyester resin (Vylon RV 200, manufactured by Toyobo Co., Ltd.) | 30 parts |
| Fluorescent colorant 3 (LUMIKOL #1000, manufactured by NIPPON KEIKO KAGAKU CO., LTD.) | 0.5 part |
| Fluorescent colorant 4 (Sinloihi Color 303, manufactured by Sinloihi Co., Ltd.) | 0.5 part |
| Toluene | 35 parts |
| Methyl ethyl ketone | 35 parts |

Example 1-3

A 4.5 μm-thick polyethylene terephthalate film manufactured by Toray Industries, Inc. was provided as a substrate. A coating liquid having the following composition for a heat-fusion ink layer was gravure coated onto one side of the substrate at a coverage of 5 g/m$^2$ on a dry basis, and the coating was dried to prepare a thermal transfer sheet. A backside layer having a thickness of 1 g/m$^2$ on a dry basis was previously formed on the substrate in its side remote from the heat-fusion ink layer. Printing was carried out using the thermal transfer sheet on a 50 μm-thick polyethylene terephthalate film (manufactured by Toray Industries, Inc.) by means of a commercially available label printer to prepare a security element of Example 1-3.

| <Coating liquid for heat-fusion ink layer> | |
|---|---|
| Paraffin wax | 70 parts |
| Ethylene-vinyl acetate copolymer | 10 parts |
| Carnauba wax | 10 parts |
| Fluorescent colorant 1 (C.I. Fluorescent 90) | 2 parts |
| Fluorescent colorant 2 (Sinloihi Color 305, manufactured by Sinloihi Co., Ltd.) | 2 parts |
| Solvent | 100 parts |

Example 1-4

A 12 μm-thick polyester film manufactured by Toray Industries, Inc. was provided as a substrate. A backside layer having a thickness of 1 g/m$^2$ on a dry basis was previously formed on one side of the substrate. An adhesive layer having a thickness of 2 g/m$^2$ on a dry basis, a peel layer having a thickness of 5 g/m$^2$ on a dry basis, a protective layer having a thickness of 3 g/m$^2$ on a dry basis, and a receptive layer having a thickness of 3 g/m$^2$ on a dry basis were formed in that order on the substrate in its side remote from the backside layer to prepare an intermediate transfer recording medium. In this case, an ink coating liquid having the following composition for an adhesive layer, an ink coating liquid having the following composition for a peel layer, a coating liquid having the following composition for a protective layer, and a coating liquid having the following composition for a receptive layer were used for the formation of the adhesive layer, the peel layer, the protective layer, and the receptive layer, respectively. In this case, the peel layer, the protective layer, and the receptive layer constitute a transfer part.

| <Ink coating liquid for adhesive layer> | |
|---|---|
| Polyester resin (Vylon 200, manufactured by Toyobo Co., Ltd.) | 20 parts |
| Methyl ethyl ketone/toluene (weight ratio = 1/1) | 80 parts |
| <Ink coating liquid for peel layer> | |
| Silicone resin ink (KS 770 A, manufactured by The Shin-Etsu Chemical Co., Ltd., solid content 30 wt %) | 50 parts |
| Microsilica (average particle diameter 1 μm) | 7.5 parts |
| Toluene | 50 parts |
| <Coating liquid for protective layer> | |
| Polymethyl methacrylate resin (BR-85, manufactured by Mitsubishi Rayon Co., Ltd.) | 20 parts |
| Methyl ethyl ketone | 80 parts |
| <Coating liquid for receptive layer> | |
| Vinyl chloride-vinyl acetate copolymer resin (VYHD, manufactured by Union Carbide) | 17.0 parts |
| Fluorescent colorant 1 (C.I. Fluorescent 90) | 0.5 part |
| Fluorescent colorant 2 (Sinloihi Color 305, manufactured by Sinloihi Co., Ltd.) | 0.5 part |
| Amino-modified silicone (KS-343, manufactured by The Shin-Etsu Chemical Co., Ltd.) | 0.17 part |
| Epoxy-modified silicone (KF-393, manufactured by The Shin-Etsu Chemical Co., Ltd.) | 0.17 part |
| Methyl ethyl ketone | 82.6 parts |

A thermal transfer sheet comprising dye layers of yellow, magenta, and cyan provided in a face serial manner was provided. An image was formed using the thermal transfer sheet on the receptive layer in the intermediate transfer recording medium by means of a commercially available video printer. Thereafter, the intermediate transfer recording medium was put on top of a 50 μm-thick polyethylene terephthalate film (manufactured by Toray Industries, Inc.) as an object so that the receptive layer face with the image formed thereon was brought into contact with the object. The transfer part composed of the peel layer, the protective layer, and the receptive layer was transferred by a heating roll method from the thermal transfer sheet onto the object. Thus, a security element of Example 1-4 was prepared.

Comparative Example 1-1

A security element of Comparative Example 1-1 was prepared in the same manner as in Example 1-1, except that the coating liquid for a fluorescent colorant layer used in the preparation of the security element of Example 1-1 was changed to a coating liquid 3 having the following composition for a fluorescent colorant layer.

| <Coating liquid 3 for fluorescent colorant layer> | |
|---|---|
| Polyester resin (Vylon RV 200, manufactured by Toyobo Co., Ltd.) | 30 parts |
| Fluorescent colorant 2 (Sinloihi Color 305, manufactured by Sinloihi Co., Ltd.) | 0.5 part |
| Toluene | 35 parts |
| Methyl ethyl ketone | 35 parts |

Comparative Example 1-2

A security element of Comparative Example 1-2 was prepared in the same manner as in Example 1-1, except that the coating liquid for a fluorescent colorant layer used in the preparation of the security element of Example 1-1 was changed to a coating liquid 4 having the following composition for a fluorescent colorant layer.

| <Coating liquid 4 for fluorescent colorant layer> | |
|---|---|
| Polyester resin (Vylon RV 200, manufactured by Toyobo Co., Ltd.) | 30 parts |
| Fluorescent colorant 1 (C.I. Fluorescent 90) | 0.5 part |
| Toluene | 35 parts |
| Methyl ethyl ketone | 35 parts |

Comparative Example 1-3

In the same manner as in Example 1-1, a coating liquid 5 having the following composition for a fluorescent colorant layer was thoroughly stirred to prepare a dispersion. The dispersion was coated onto one side of a 50 μm-thick polyethylene terephthalate (PET) film manufactured by Toray Industries, Inc. as a substrate by means of a wire bar at a coverage of 5 g/m$^2$ on a dry basis. The coating was fully dried in a hot air oven.

| <Coating liquid 5 for fluorescent colorant layer> | |
|---|---|
| Polyester resin (Vylon RV 200, manufactured by Toyobo Co., Ltd.) | 30 parts |
| Fluorescent colorant 1 (C.I. Fluorescent 90) | 0.5 part |
| Toluene | 35 parts |
| Methyl ethyl ketone | 35 parts |

Next, a coating liquid 6 having the following composition for a fluorescent colorant layer was thoroughly stirred to prepare a dispersion. The dispersion was coated onto the coated PET film in its coated face by means of a wire bar at a coverage of 5 g/m$^2$ on a dry basis. The coating was fully dried in a hot air oven to prepare a security element of Comparative Example 1-3.

| <Coating liquid 6 for fluorescent colorant layer> | |
|---|---|
| Polyester resin (Vylon RV 200, manufactured by Toyobo Co., Ltd.) | 30 parts |
| Fluorescent colorant 2 (Sinloihi Color 305, manufactured by Sinloihi Co., Ltd.) | 0.5 part |
| Toluene | 35 parts |
| Methyl ethyl ketone | 35 parts |

For the security elements of Examples 1-1 and 1-2 and Comparative Examples 1-1, 1-2, and 1-3, a fluorescent spectrum was measured with a fluorescence spectrophotometer FP-6600, manufactured by Japan Spectroscopic Co., Ltd.

The results of the measurement are shown in Table 1 below.

TABLE 1

| | Absorption peak wave-length, nm | Emission peak wave-length, nm | Remarks |
|---|---|---|---|
| Ex. 1-1 | 380 | 434 | Attributable to fluorescent colorant 1 |
| | 395 | 506 | *1) |
| | 450 | 508 | Attributable to fluorescent colorant 2 |
| Ex. 1-2 | 345 | 522 | Attributable to fluorescent colorant 3 |
| | 345 | 586 | *2) |
| | 565 | 590 | Attributable to fluorescent colorant 4 |
| Comp. Ex. 1-1 | 450 | 508 | Attributable to fluorescent colorant 2 |
| Comp. Ex. 1-2 | 385 | 430 | Attributable to fluorescent colorant 1 |
| Comp. Ex. 1-3 | 370 | 434 | Attributable to fluorescent colorant 1 |
| | 450 | 506 | Attributable to fluorescent colorant 2 |

*1) Emission from fluorescent colorant 2 after absorption of light emitted from fluorescent colorant 1 in fluorescent colorant 2
*2) Emission from fluorescent colorant 4 after absorption of light emitted from fluorescent colorant 3 in fluorescent colorant 4

As is apparent from the above table, for Example 1-1, in addition to an absorption peak and an emission peak for each of the fluorescent colorants 1 and 2 per se used, an absorption peak and an emission peak appear which show that the fluorescent colorant 2 has absorbed light emitted from the fluorescent colorant 1 and then has emitted light attributable to the light absorption (absorption peak at 395 nm, emission peak at 506 nm). For Example 1-2, similar absorption peak and emission peak appear (absorption peak at 345 nm, emission peak at 586 nm).

In Table 1, for Example 1-1, upon the application of light with wavelengths around 380 to 395 nm, two emission peaks, an emission peak at 434 nm and an emission peak at 506 nm, were detected. Likewise, for Example 1-2, upon the application of light with a wavelength around 345 nm, two emission peaks, an emission peak at 522 nm and an emission peak at 586 nm, were detected. These two emission peaks are those which cannot be provided from a single fluorescent colorant. Further, for Example 1-1, in addition to the two emission peaks respectively at 434 nm and 506 nm, an absorption peak attributable to the absorption of light with a wavelength of 450 nm and an emission peak at 508 nm were detected (attributable to the fluorescent colorant 2).

For Example 1-2, in addition to the two emission peaks respectively at 522 nm and 586 nm, an absorption peak attributable to the absorption of light with a wavelength of 565 nm and an emission peak at 590 nm were detected (attributable to the fluorescent colorant 4).

In Table 1, for Comparative Example 1-3 wherein the two fluorescent colorants used in Example 1-1 were contained in respective separate fluorescent colorant-containing layers which were stacked on top of each other, only an absorption peak and an emission peak attributable to the fluorescent colorant 1 per se and an absorption peak and an emission peak attributable to the fluorescent colorant 2 per se were detected, and an absorption peak and an emission peak, indicating emission from the fluorescent colorant 2 after the absorption of light emitted from the fluorescent colorant 1 in the fluorescent colorant 2, could not be confirmed.

For the security elements of Examples 1-3 and 1-4 prepared above, upon the application of ultraviolet light, two types of fluorescence different from each other in color were given off, and these fluorescent colors were finely strewn and dispersed. Therefore, the forgery and alteration of the security elements were difficult, and the security elements had a high level of security. For the security element of Example 1-4, the two types of fluorescence different from each other in color were given off, and a thermal transferred color image of yellow, magenta, and cyan was provided. This made the security element of Example 1-4 useful.

Example 2-1

A 50 μm-thick polyethylene terephthalate film manufactured by Toray Industries, Inc. was provided as a substrate. A coating liquid 1 having the following composition for a fluorescent colorant layer was thoroughly stirred to prepare a dispersion. The dispersion was coated onto one side of the substrate by means of a wire bar at a coverage of 5 g/m$^2$ on a dry basis. The coating was fully dried in a hot air oven to prepare a security element of Example 2-1.

| <Coating liquid 1 for fluorescent colorant layer> | |
|---|---|
| Polyester resin (Vylon RV 200, manufactured by Toyobo Co., Ltd.) | 30 parts |
| Fluorescent colorant 1 Rare earth element-containing fine particles (fine particles of Y, O:Yb, Tm; average particle diameter about 30 nm) | 0.5 part |
| Fluorescent colorant 2 (Sinloihi Color 305, manufactured by Sinloihi Co., Ltd.) | 0.5 part |
| Toluene | 35 parts |
| Methyl ethyl ketone | 35 parts |

Example 2-2

A security element of Example 2-2 was prepared in the same manner as in Example 2-1, except that the coating liquid for a fluorescent colorant layer used in the preparation of the security element of Example 2-1 was changed to a coating liquid 2 having the following composition for a fluorescent colorant layer.

| <Coating liquid 2 for fluorescent colorant layer> | |
|---|---|
| Polyester resin (Vylon RV 200, manufactured by Toyobo Co., Ltd.) | 30 parts |
| Fluorescent colorant 3 Rare earth element-containing fine particles (fine particles of Y, O:Er; average particle diameter about 30 nm) | 0.5 part |
| Fluorescent colorant 4 (Sinloihi Color 303, manufactured by Sinloihi Co., Ltd.) | 0.5 part |
| Toluene | 35 parts |
| Methyl ethyl ketone | 35 parts |

Example 2-3

A 4.5 μm-thick polyethylene terephthalate film manufactured by Toray Industries, Inc. was provided as a substrate. A coating liquid having the following composition for a heat-fusion ink layer was gravure coated onto one side of the substrate at a coverage of 5 g/m$^2$ on a dry basis, and the coating was dried to prepare a thermal transfer sheet. A backside layer having a thickness of 1 g/m$^2$ on a dry basis was previously formed on the substrate in its side remote from the heat-fusion ink layer. Printing was carried out using the thermal transfer sheet on a 50 μm-thick polyethylene terephthalate film (manufactured by Toray Industries, Inc.) by means of a commercially available label printer to prepare a security element of Example 2-3.

| <Coating liquid for heat-fusion ink layer> | |
|---|---|
| Paraffin wax | 70 parts |
| Ethylene-vinyl acetate copolymer | 10 parts |
| Carnauba wax | 10 parts |
| Fluorescent colorant 1 Rare earth element-containing fine particles (fine particles of Y, O:Yb, Tm; average particle diameter about 30 nm) | 2 parts |
| Fluorescent colorant 2 (Sinloihi Color 305, manufactured by Sinloihi Co., Ltd.) | 2 parts |
| Solvent | 100 parts |

Example 2-4

A 12 μm-thick polyester film manufactured by Toray Industries, Inc. was provided as a substrate. A backside layer having a thickness of 1 g/m$^2$ on a dry basis was previously formed on one side of the substrate. An adhesive layer having a thickness of 2 g/m$^2$ on a dry basis, a peel layer having a thickness of 5 g/m$^2$ on a dry basis, a protective layer having a thickness of 3 g/m$^2$ on a dry basis, and a receptive layer having a thickness of 3 g/m$^2$ on a dry basis were formed in that order on the substrate in its side remote from the backside layer to prepare an intermediate transfer recording medium. In this case, an ink coating liquid having the following composition for an adhesive layer, an ink coating liquid having the following composition for a peel layer, a coating liquid having the following composition for a protective layer, and a coating liquid having the following composition for a receptive layer were used for the formation of the adhesive layer, the peel layer, the protective layer, and the receptive layer, respectively. In this case, the peel layer, the protective layer, and the receptive layer constitute a transfer part.

| | |
|---|---|
| <Ink coating liquid for adhesive layer> | |
| Polyester resin (Vylon RV 200, manufactured by Toyobo Co., Ltd.) | 20 parts |
| Methyl ethyl ketone/toluene (weight ratio = 1/1) | 80 parts |
| <Ink coating liquid for peel layer> | |
| Silicone resin ink (KS 770 A, manufactured by The Shin-Etsu Chemical Co., Ltd., solid content 30 wt %) | 50 parts |
| Microsilica (average particle diameter 1 μm) | 7.5 parts |
| Toluene | 50 parts |
| <Coating liquid for protective layer> | |
| Polymethyl methacrylate resin (BR-85, manufactured by Mitsubishi Rayon Co., Ltd.) | 20 parts |
| Methyl ethyl ketone | 80 parts |
| <Coating liquid for receptive layer> | |
| Vinyl chloride-vinyl acetate copolymer resin (VYHD, manufactured by Union Carbide) | 17.0 parts |

-continued

| | |
|---|---|
| Fluorescent colorant 1 | 0.5 part |
| Rare earth element-containing fine particles (fine particles of Y, O:Yb, Tm; average particle diameter about 30 nm) | |
| Fluorescent colorant 2 (Sinloihi Color 305, manufactured by Sinloihi Co., Ltd.) | 0.5 part |
| Amino-modified silicone (KS-343, manufactured by The Shin-Etsu Chemical Co., Ltd.) | 0.17 part |
| Epoxy-modified silicone (KF-393, manufactured by The Shin-Etsu Chemical Co., Ltd.) | 0.17 part |
| Methyl ethyl ketone | 82.6 parts |

A thermal transfer sheet comprising dye layers of yellow, magenta, and cyan provided in a face serial manner was provided. An image was formed using the thermal transfer sheet on the receptive layer in the intermediate transfer recording medium by means of a commercially available video printer. Thereafter, the intermediate transfer recording medium was put on top of a 50 μm-thick polyethylene terephthalate film (manufactured by Toray Industries, Inc.) as an object so that the receptive layer face with the image formed thereon was brought into contact with the object. The transfer part composed of the peel layer, the protective layer, and the receptive layer was transferred by a heating roll method from the thermal transfer sheet onto the object. Thus, a security element of Example 2-4 was prepared.

Comparative Example 2-1

A security element of Comparative Example 2-1 was prepared in the same manner as in Example 2-1, except that the coating liquid for a fluorescent colorant layer used in the preparation of the security element of Example 2-1 was changed to a coating liquid 3 having the following composition for a fluorescent colorant layer.

| <Coating liquid 3 for fluorescent colorant layer> | |
|---|---|
| Polyester resin (Vylon RV 200, manufactured by Toyobo Co., Ltd.) | 30 parts |
| Fluorescent colorant 2 (Sinloihi Color 305, manufactured by Sinloihi Co., Ltd.) | 0.5 part |
| Toluene | 35 parts |
| Methyl ethyl ketone | 35 parts |

Comparative Example 2-2

A security element of Comparative Example 2-2 was prepared in the same manner as in Example 2-1, except that the coating liquid for a fluorescent colorant layer used in the preparation of the security element of Example 2-1 was changed to a coating liquid 4 having the following composition for a fluorescent colorant layer.

| <Coating liquid 4 for fluorescent colorant layer> | |
|---|---|
| Polyester resin (Vylon RV 200, manufactured by Toyobo Co., Ltd.) | 30 parts |
| Fluorescent colorant 1 | 0.5 part |

-continued

| <Coating liquid 4 for fluorescent colorant layer> | |
|---|---|
| Rare earth element-containing fine particles (fine particles of Y, O:Yb, Tm; average particle diameter about 30 nm) | |
| Toluene | 35 parts |
| Methyl ethyl ketone | 35 parts |

Comparative Example 2-3

In the same manner as in Example 2-1, a coating liquid 5 having the following composition for a fluorescent colorant layer was thoroughly stirred to prepare a dispersion. The dispersion was coated onto one side of a 50 μm-thick polyethylene terephthalate (PET) film manufactured by Toray Industries, Inc. as a substrate by means of a wire bar at a coverage of 5 g/m$^2$ on a dry basis. The coating was fully dried in a hot air oven.

| <Coating liquid 5 for fluorescent colorant layer> | |
|---|---|
| Polyester resin (Vylon RV 200, manufactured by Toyobo Co., Ltd.) | 30 parts |
| Fluorescent colorant 1 | 0.5 part |
| Rare earth element-containing fine particles (fine particles of Y, O:Yb, Tm; average particle diameter about 30 nm) | |
| Toluene | 35 parts |
| Methyl ethyl ketone | 35 parts |

Next, a coating liquid 6 having the following composition for a fluorescent colorant layer was thoroughly stirred to prepare a dispersion. The dispersion was coated onto the coated PET film in its coated face by means of a wire bar at a coverage of 5 g/m$^2$ on a dry basis. The coating was fully dried in a hot air oven to prepare a security element of Comparative Example 2-3.

| <Coating liquid 6 for fluorescent colorant layer> | |
|---|---|
| Polyester resin (Vylon RV 200, manufactured by Toyobo Co., Ltd.) | 30 parts |
| Fluorescent colorant 2 (Sinloihi Color 305, manufactured by Sinloihi Co., Ltd.) | 0.5 part |
| Toluene | 35 parts |
| Methyl ethyl ketone | 35 parts |

The security elements of Examples 2-1 and 2-2 and Comparative Examples 2-1, 2-2, and 2-3 were excited with a semiconductor laser (980 nm), and emission spectra were measured.

The results of the measurement are shown in Table 2 below.

TABLE 2

| | Received light peak wavelength, nm | Remarks |
|---|---|---|
| Ex. 2-1 | 480 | Attributable to fluorescent colorant 1 |
| | 506 | *1) |

TABLE 2-continued

| | Received light peak wavelength, nm | Remarks |
|---|---|---|
| Ex. 2-2 | 550 | Attributable to fluorescent colorant 3 |
| | 586 | *2) |
| Comp. Ex. 2-1 | Peak not identifiable | |
| Comp. Ex. 2-2 | 480 | Attributable to fluorescent colorant 1 |
| Comp. Ex. 2-3 | 480 | Attributable to fluorescent colorant 1 |

*1) Emission from fluorescent colorant 2 after absorption of light emitted from fluorescent colorant 1 in fluorescent colorant 2
*2) Emission from fluorescent colorant 4 after absorption of light emitted from fluorescent colorant 3 in fluorescent colorant 4

As is apparent from the above table, for Example 2-1, in addition to an emission peak attributable to only the fluorescent colorant 1 used, an emission peak appears which shows that the fluorescent colorant 2 has absorbed light emitted from the fluorescent colorant 1 and then has emitted light attributable to the light absorption (emission peak at 506 nm). For Example 2-2, a similar emission peak appears (emission peak at 586 nm).

In Table 2, for Example 2-1, upon the application of light with a wavelength of 980 nm, two emission peaks, an emission peak at 480 nm and an emission peak at 506 nm, were detected. Likewise, for Example 2-2, upon the application of light with a wavelength of 980 nm, two emission peaks, an emission peak at 550 nm and an emission peak at 586 nm, were detected. These two emission peaks are those which cannot be provided from a single fluorescent colorant.

In Table 2, for Comparative Example 2-3 wherein the two fluorescent colorants used in Example 2-1 were contained in respective separate fluorescent colorant-containing layers which were stacked on top of each other, only an emission peak attributable to the fluorescent colorant 1 per se was detected. For the fluorescent colorant 2, since the semiconductor laser (980 nm) could not be excitation light, any emission of light attributable to the fluorescent colorant 2 could not be confirmed. In the case where the fluorescent colorant 1 and the fluorescent colorant 2 were contained in respective separate layers which were stacked on top of each other, any emission peak showing emission of light from the fluorescent colorant 2 after the absorption of light emitted from the fluorescent colorant 1 could not be confirmed.

For the security elements of Examples 2-3 and 2-4 prepared above, upon the application of a semiconductor laser (980 nm) beam, two types of fluorescence different from each other in color were given off. Because of the emission of the two fluorescent colors, the forgery and alteration of the security elements were difficult, and the security elements had a high level of security. For the security element of Example 2-4, the two types of fluorescence different from each other in color were given off, and a thermal transferred color image of yellow, magenta, and cyan was provided. This made the security element of Example 2-4 useful.

As described above, for the security elements according to the present invention, upon the application of a single light with wavelength $\lambda_1$ to the security elements, two or more types of fluorescence different from each other or one another in color with, for example, wavelength $\lambda_2$, wavelength $\lambda_3$, and wavelength $\lambda_4$ can be simultaneously given off. Further, these fluorescent colors can be finely strewn and dispersed. Therefore, the forgery and alteration of the security elements are difficult. Thus, security elements having a high level of security can be provided. In a preferred embodiment of the present invention, a security element having a high level of security can be provided in which, although any fluorescent color is not visible under ordinary visible light, two or more fluorescent colors can be perceived upon the application of light other than the visible light, that is, ultraviolet light or infrared light.

The invention claimed is:

1. A security element comprising at least a substrate and a fluorescent colorant layer provided on the substrate, wherein said fluorescent colorant layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

2. The security element according to claim 1, wherein the fluorescent colorant $F_1$ is substantially white or colorless under visible light and, upon absorption of ultraviolet or infrared light, emits fluorescence.

3. The security element according to claim 1, wherein the fluorescent colorant $F_1$ is excited by light with a wavelength in the range of 500 nm to 2,000 nm to cause upconversion emission.

4. The security element according to claim 3, wherein the fluorescent colorant $F_1$, which causes the upconversion emission, contains one or more rare earth elements selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) and mixtures thereof.

5. The security element according to claim 1, which comprises fixed image information and/or variable image information provided by the fluorescent colorants.

6. A thermal transfer sheet comprising at least a substrate and a heat-fusion ink layer provided on the substrate, wherein said heat-fusion ink layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

7. The thermal transfer sheet according to claim 6, wherein the fluorescent colorant $F_1$ is substantially white or colorless under visible light and, upon absorption of ultraviolet or infrared light, emits fluorescence.

8. The thermal transfer sheet according to claim 6, wherein the fluorescent colorant $F_1$ is excited by light with a wavelength in the range of 500 nm to 2,000 nm to cause upconversion emission.

9. The thermal transfer sheet according to claim 8, wherein the fluorescent colorant $F_1$, which causes the upconversion emission, contains one or more rare earth elements selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) and mixtures thereof.

10. The thermal transfer sheet according to claim 6, which comprises fixed image information and/or variable image information provided by the fluorescent colorants.

11. A method for the formation of a security element comprising at least a substrate and a fluorescent colorant-containing heat-fusion ink layer provided on the substrate, said method comprising the step of: transferring the heat-fusion ink layer in the thermal transfer sheet according to claim 6 onto the substrate.

12. An intermediate transfer recording medium comprising at least a substrate and a transfer part including a receptive layer and provided separably on the substrate, wherein said receptive layer or said transfer part in its part other than the receptive layer comprises N species of fluorescent colorants $F_n$, wherein N is an integer of 2 or more and n is an integer of not less than one and not more than N, in the same layer, and the fluorescent colorant $F_n$ absorbs light with a wavelength of $\lambda_n$ and emits fluorescence with a wavelength of $\lambda_{n+1}$.

13. The intermediate transfer recording medium according to claim 12, wherein the fluorescent colorant $F_1$ is substantially white or colorless under visible light and, upon absorption of ultraviolet or infrared light, emits fluorescence.

14. The intermediate transfer recording medium according to claim 12, wherein the fluorescent colorant $F_1$ is excited by light with a wavelength in the range of 500 nm to 2,000 nm to cause upconversion emission.

15. The intermediate transfer recording medium according to claim 14, wherein the fluorescent colorant $F_1$, which causes the upconversion emission, contains one or more rare earth elements selected from the group consisting of erbium (Er), holmium (Ho), praseodymium (Pr), thulium (Tm), neodymium (Nd), gadolinium (Gd), europium (Eu), ytterbium (Yb), samarium (Sm), and cerium (Ce) and mixtures thereof.

16. The intermediate transfer recording medium according to claim 12, which comprises fixed image information and/or variable image information provided by the fluorescent colorants.

17. A method for the formation of a security element comprising at least a substrate and a transfer part provided on the substrate, said method comprising the steps of: transferring a colorant onto the receptive layer in the intermediate transfer recording medium according to claim 12; and transferring the transfer part including the receptive layer with the colorant transferred thereonto onto the substrate.

* * * * *